US007845890B2

(12) United States Patent
Sasamoto et al.

(10) Patent No.: US 7,845,890 B2
(45) Date of Patent: Dec. 7, 2010

(54) BOOKBINDING DEVICE AND IMAGE FORMING APPARATUS

(75) Inventors: Shinya Sasamoto, Hokuto (JP); Kouichi Kitta, Koshu (JP)

(73) Assignee: Nisca Corporation, Minamikoma-Gun, Yamanashi (JP)

( * ) Notice: Subject to any disclaimer, the term of this patent is extended or adjusted under 35 U.S.C. 154(b) by 850 days.

(21) Appl. No.: 11/797,133

(22) Filed: May 1, 2007

(65) Prior Publication Data

US 2007/0286705 A1 Dec. 13, 2007

(30) Foreign Application Priority Data

May 2, 2006 (JP) ..... 2006-128708

(51) Int. Cl.
*B42C 11/00* (2006.01)
*B42C 13/00* (2006.01)
*B42B 9/00* (2006.01)
*G03G 15/00* (2006.01)

(52) U.S. Cl. ..... 412/13; 412/4; 412/5; 412/11; 412/14; 412/20; 399/408

(58) Field of Classification Search ..... 412/4, 412/5, 8, 10–11, 13–14, 20–23, 37; 399/408
See application file for complete search history.

(56) References Cited

U.S. PATENT DOCUMENTS 5,876,170 A * 3/1999 Geiser ..... 412/8
6,685,416 B2 * 2/2004 Itoh et al. ..... 412/37
6,692,208 B1 * 2/2004 Watkiss et al. ..... 412/1
7,156,601 B2 * 1/2007 Cobene, II ..... 412/8

FOREIGN PATENT DOCUMENTS

JP 2005104063 * 10/2003

* cited by examiner

*Primary Examiner*—Dana Ross
*Assistant Examiner*—Kyle Grabowski
(74) *Attorney, Agent, or Firm*—Manabu Kanesaka

(57) ABSTRACT

A bookbinding device includes a collecting device for collecting sheets into a bundle and a bookbinding path that includes a sheet bundle conveying device, an adhesive applying device, a cover binding device, and a cover sheet feeding path. The cover binding device includes a back folding press member for the cover sheet and a back rest plate member to back up the cover sheet. A control device allows the back folding press member to execute a back folding process with a small gap formed between the back rest plate member and a back of the sheet bundle. The control device further allows the back of the sheet bundle to abut against the back rest plate member to forcibly cool the adhesive. The control device varies the time required for the cooling depending on the thickness of the sheet bundle.

12 Claims, 13 Drawing Sheets

Thinner sheets

Thicker sheet bundle

Thinner sheets

Alignment reference

FIG.13

| Sheet count | Paste drying wait time |
|---|---|
| Less than 60 | No wait time |
| 60 to 69 | 10 seconds |
| 70 to 79 | 20 seconds |
| 80 to 89 | 30 seconds |
| 90 to 99 | 40 seconds |
| 100 to 109 | 50 seconds |
| 110 or more | 60 seconds |

BOOKBINDING DEVICE AND IMAGE FORMING APPARATUS

BACKGROUND OF THE INVENTION AND RELATED ART STATEMENT

The present invention relates to a bookbinding device that sets sheets with images formed by an image forming apparatus or the like, applies an adhesive to the back of the sheet bundle, and binds a cover sheet to the sheet bundle. More specifically, the present invention relates to a bookbinding device that joins a sheet bundle with an adhesive applied to its back to the center of a front cover sheet, which is then back-folded for casing-in.

Common bookbinding devices of this kind include automatic bookbinding devices serving as terminal devices for image forming apparatuses such as printers and printing machines to stack sheets with images formed thereon so as to arrange the sheets in a bundle, apply an adhesive to end surfaces of the sheet bundle, and bind the sheet bundle to a cover sheet. Other devices of this kind include bookbinding devices that set printed sheets fed from a sheet feeding port and then bind the sheets to a cover sheet. In particular, for on-demand printing for electronic publishing or the like, known systems simultaneously perform a printing process and a bookbinding process by printing predetermined documents, while automatically binding the documents to a cover to form a book.

As an example of the above system, Japanese Patent Laid-Open Publication No. 2004-209867 discloses a device that automatically bookbinds sheets output by an image forming apparatus. According to this document, the device receives sheets output by an image forming apparatus through a sheet discharging port, guides the sheets to a sheet carry-in path, collects the sheets on a placement tray provided downstream of the path, rotates the sheet bundle in its horizontal posture collected on the tray through 90°, and guides the sheet bundle in its vertical posture to an adhesive pasting device for an applying process. The system device then folds the adhesive-pasted sheet bundle together with a cover sheet fed from an image forming apparatus or an inserter for binding.

A known method for bookbinding in these bookbinding systems is a casing-in operation involving joining a sheet bundle with an adhesive applied to its back to the center of a cover sheet carried in from a direction orthogonal to the sheet bundle, and folding the front cover together with the sheet bundle to form a book-like sheet bundle. In this case, the cover sheet with the sheet bundle joined to its center is pressed by a lateral pair of back folding blocks to form the back of the resulting book. Accordingly, the lateral pair of back folding blocks is shaped like a press die, and the back folding blocks, at respective standby positions located laterally away from each other relative to the central back folding position, approach each other to fold the back of the cover sheet at the central back folding position.

Japanese Patent Laid-Open Publication No. 2005-104063 discloses a technique for binding a cover sheet to a sheet bundle with an adhesive applied thereto and then adjusting a cooling time required to cool and solidify the adhesive in accordance with the thickness of the sheet bundle. According to this publication, the adhesive cooling time is set equal to the amount of time from the end of a bookbinding process until the beginning of the subsequent cutting process step.

As described above, when a hot-melt adhesive is applied to the back of the sheet bundle, which is then bound to the front sheet for bookbinding, the cooling time needs to be set in accordance with, for example, the thickness of the sheet bundle so that the adhesive is solidified before the subsequent step is reached. This is because a thicker sheet bundle requires a larger amount of adhesive applied and thus a longer cooling time. However, the adhesive cooling time is conventionally set equal to the time required to transfer the sheet bundle with the cover sheet bound thereto to the subsequent step. This disadvantageously increases the time required for a bookbinding process. That is, a thicker sheet bundle and a larger amount of adhesive applied increase the time required for a bookbinding process. Thus, for a continuous bookbinding process, the operation cannot be finished in time for the processing of the subsequent sheet bundle.

Thus, when a hot-melt adhesive is applied to the back of the sheet bundle, which is then bound to the front sheet, the applied adhesive needs to permeate through the sheets of the sheet bundle for reliable binding. This requires the adhesive to exhibit a high fluidity (low viscosity) at high temperatures. On the other hand, the high fluidity at high temperatures may cause the adhesive to leak to the back cover during pressing with the back folding blocks. In particular, pressing the back cover against a back rest plate causes an excessive amount of adhesive to leak, resulting in inappropriate bookbinding. In contrast, when the adhesive exhibits a low fluidity (high viscosity) at low temperatures, the back of the cover cannot be folded into sharp fold lines during pressing, or recesses and projections or crimps may be created on the back cover. Thus, desirably, when the sheet bundle and the cover sheet are bound together, the adhesive exhibits a high fluidity at relatively high temperatures during back folding pressing, and is rapidly solidified after the back folding. However, no improvements in the back folding mechanism based on the above knowledge have been made.

SUMMARY OF THE INVENTION

One aspect of the present invention has collecting means for collecting sequentially supplied sheets in a bundle and a bookbinding path along which the sheet bundle from the collecting means is transferred. Sheet bundle conveying means, adhesive applying means, and cover binding means are arranged on the path. The cover binding means has a cover sheet conveying path along which a cover sheet is fed from a direction crossing the bookbinding path. The cover binding means comprises a back folding press member that back-folds the cover sheet and a back rest plate member located downstream of the back folding press member to back up the cover sheet. Control means for the cover binding means (cover binding control means) performs control such that a back folding process is executed by controlling the back folding press member with a small gap formed between the back rest plate member and a back of the sheet bundle. After the back folding process, an adhesive is cooled with the back of the sheet cover abutted against the back rest plate member, and after a cooling time for the adhesive passes, the back rest plate is retracted from the bookbinding path to the outside of the path.

Thus, when the back end surface of the sheet bundle with the adhesive applied thereto is folded by the back folding press member, a small gap is formed between the back end surface of the sheet bundle and the back rest plate member. This gap prevents the adhesive from being cooled by the plate member, allowing the back cover to be folded into the correct shape. Further, after the back folding process, the back of the sheet bundle is abutted against the back rest plate member to forcibly cool and solidify the adhesive.

The cover binding control means may be configured so that when the adhesive layer is forcibly cooled by the back rest plate member, the cooling time is varied depending on the thickness of the sheet bundle. In this case, the device comprises sheet bundle thickness detecting means or counting means for counting the number of sheets in the sheet bundle so that the cooling time can be set on the basis of sheet bundle thickness information from the sheet bundle thickness detecting means or the counting means.

In forming a predetermined gap between the back of the sheet bundle and the back rest plate member, the cover binding control means may control the amount that the sheet bundle is transferred by the sheet bundle conveying means. The back rest plate member comprises a heat conductive material, such as metal, to cool the back of the sheet bundle back-folded by the back folding press member. This enables the speed at which the adhesive is cooled to be suitably set by appropriately selecting the heat conductivity. Further, the sheet bundle conveying means comprises grip conveying means for gripping and conveying the sheet bundle. When the back folding press member back-folds the cover sheet, the cover binding control means performs control such that a back folding process is executed with the back folding end of the sheet bundle gripped by the grip conveying means. After the back folding process, the sheet bundle, with its centrally back end gripped by the grip conveying means, is fed to downstream carry-out roller means.

The cover binding control means performs control such that after the back folding process, the grip conveying means is released, and the back of the sheet bundle is then abutted against the back rest plate member.

Thus, when the grip conveying means releases the sheet bundle, the sheet bundle is abutted against the back rest plate member, for example, under its own weight. This allows the adhesive to be cooled during preparation for conveyance to the subsequent step. The image forming apparatus in accordance with the present invention may be a system comprising an image forming apparatus such as a copier or a printer and the above bookbinding device coupled to a sheet discharging port in the apparatus.

When the sheet bundle, with the adhesive applied thereto, is bound to the cover sheet, a back folding process is executed by the back folding press member, a small gap being formed between the back end surface of the sheet bundle and the back rest plate that backs up the cover sheet.

After the back folding, the back of the sheet bundle is abutted against the back rest plate for cooling. Consequently, the small gap formed between the back rest plate and the adhesive layer applied to the back end surface of the sheet bundle before the back-fold prevents the rapid cooling and solidification of the adhesive and the leakage of the adhesive resulting from pressure exerted by the back rest plate.

Consequently, the cover sheet can be formed by the back folding press member into a smooth back cover with sharp edge lines and without any recesses or projections. The thus folded-back sheet bundle is abutted against the back rest plate member to cool and solidify the adhesive. In particular, the back folding press member comprising a heat conductive material such as metal enables the adhesive to be solidified and bonded in a short time. Further, the cover binding control means sets the time for the cooling state in which the back of the sheet bundle is abutted against the fold rest plate member, in accordance with the thickness of the sheet bundle. For example, a longer cooling time is set for a thicker sheet bundle, while a shorter cooling time is set for a thinner sheet bundle. This allows continuous bookbinding of sheet bundles to be efficiently achieved.

A main object of the present invention is to provide a bookbinding device that can bind a sheet bundle and a cover sheet together without creating recesses and projections or crimps or causing an adhesive to leak to surroundings. A further object of the present invention is to provide a bookbinding device that allows the adhesive to be rapidly cooled and solidified after binding. A further object of the present invention is to provide an image forming apparatus that sequentially arranges sheets with images formed thereon into a bundle and wraps the sheets with a cover sheet for bookbinding, the image forming apparatus being able to efficiently achieve bookbinding in a short time while preventing possible inappropriate bookbinding.

The other objects and features will be apparent from the description of embodiments based on the accompanying drawings.

Further objects and advantages of the invention will be apparent from the following description of the invention.

BRIEF DESCRIPTION OF THE DRAWINGS

FIG. 13 is a diagram illustrating a timer table for a cooling time in the back diagram in FIG. 11.

DETAILED DESCRIPTION OF PREFERRED EMBODIMENT

Figure 1:
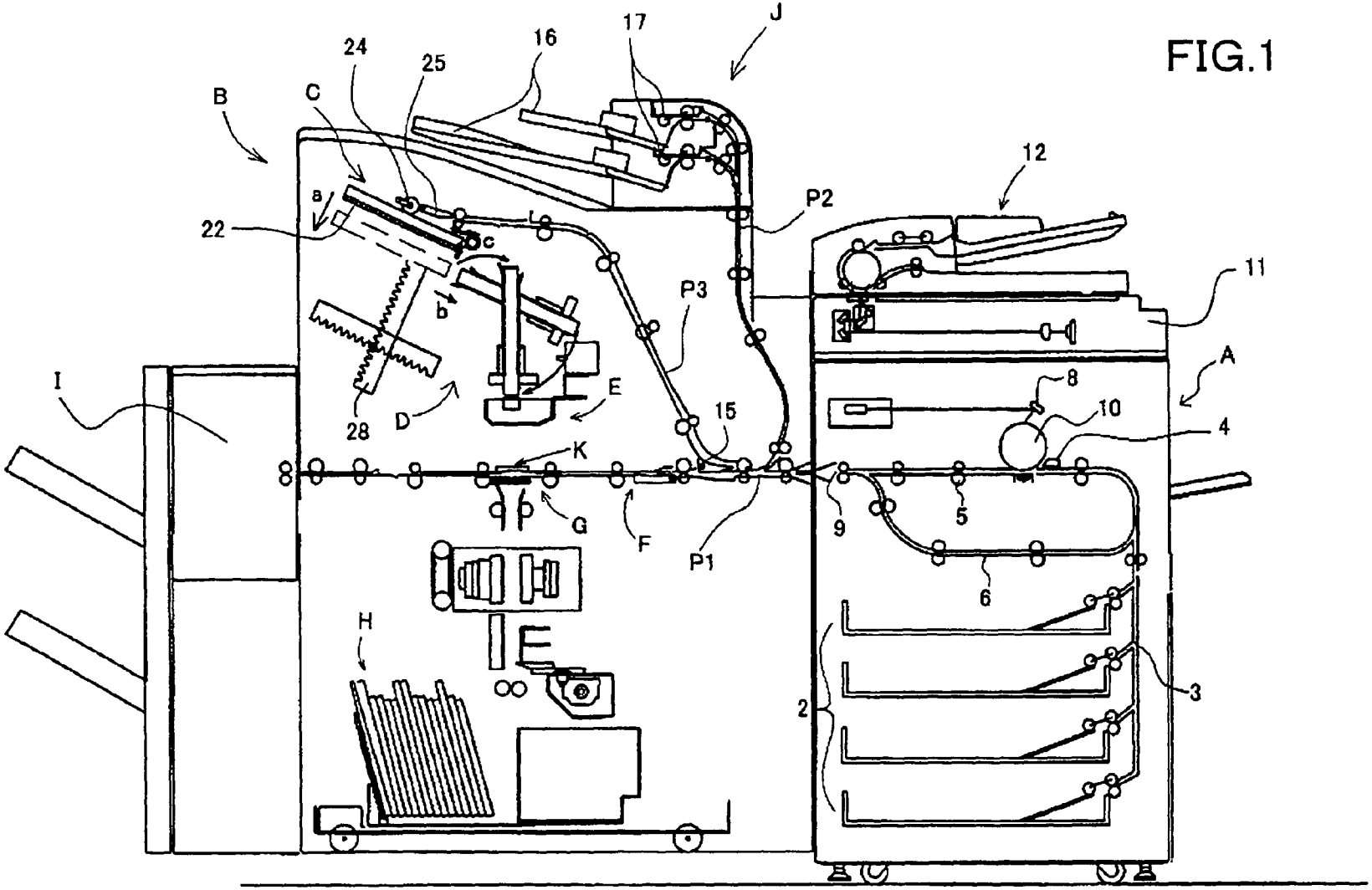
FIG. 1 is a diagram showing the entire configuration of an image forming apparatus comprising a bookbinding device in accordance with the present invention.
Figure 2:
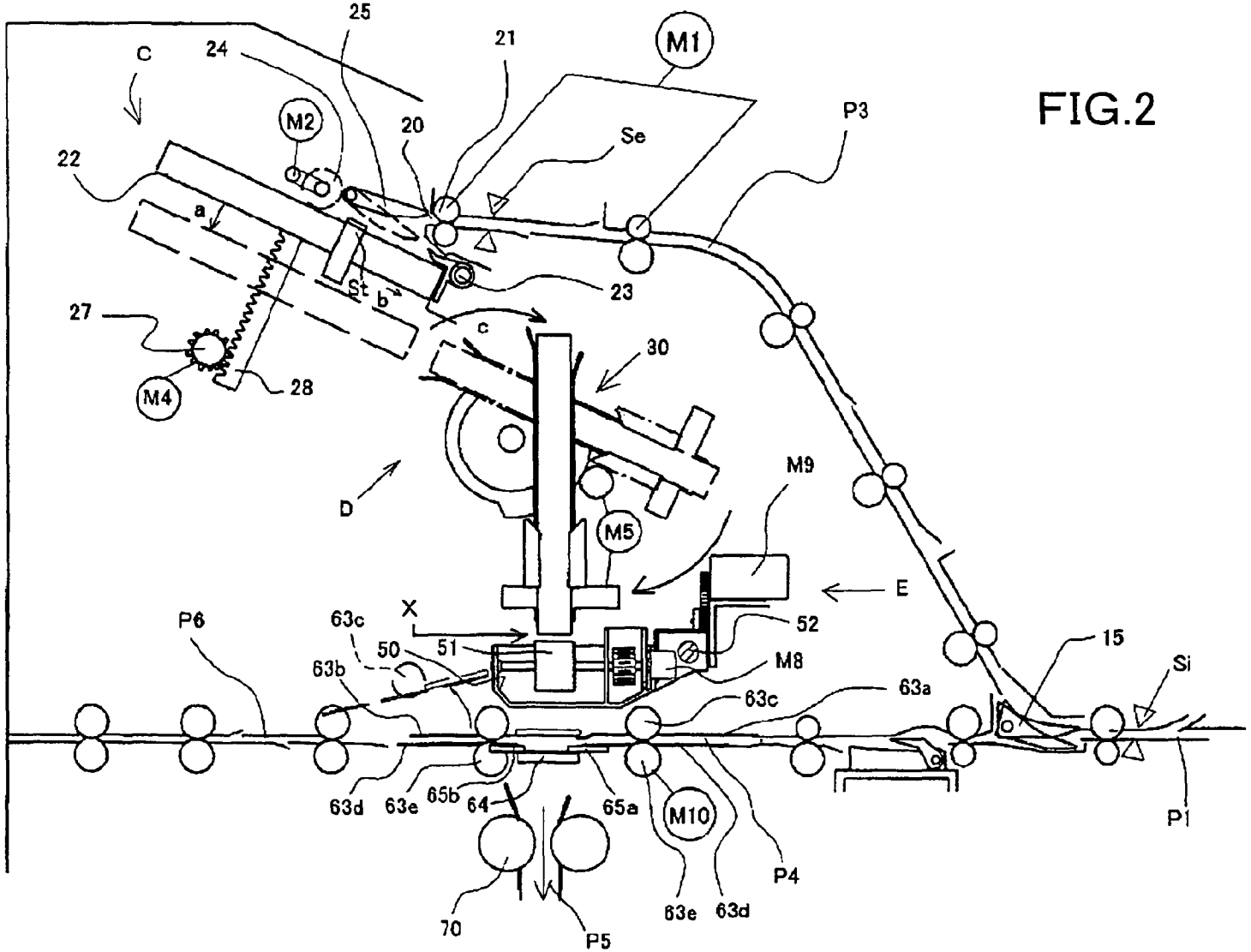
FIG. 2 is an enlarged view of the bookbinding device in the apparatus in FIG. 1.

With reference to the drawings, a detailed description will be given below of an embodiment of a sheet feeding device and an image reading device in accordance with the present invention. FIG. 1 is a diagram showing the entire configuration of a bookbinding device in accordance with the present invention. FIG. 2 is an enlarged diagram illustrating the essential part of the bookbinding device A bookbinding device B in accordance with the present invention is coupled to an image forming apparatus A, for example, as shown in FIG. 1. The bookbinding device B arranges sheets with images formed thereon by the image forming apparatus A, into a bundle, applies an adhesive such as paste to end surfaces of the sheet bundle, joins the sheet bundle to a cover sheet, and back-folds and presses the cover sheet for bookbinding. The cover sheet is fed from a direction crossing a conveying path for the sheet bundle by the image forming apparatus or an inserter. FIG. 1 shows such an image forming system. The image forming apparatus A and the bookbinding device B will be described below in this order.

The image forming apparatus A will be described. The image forming apparatus A is incorporated into a system such as a computer or a word processor to print a series of documents on sheets and discharge the sheets from a sheet discharging port 9. Printing means may be laser, ink jet, or offset printing. The printing means is composed of a print drum 10 such as an electrostatic drum; a sheet feeding cassette 2 from which sheets are fed to the print drum 10; a print head 8 using laser, or the like, to form images on the print drum 10; a developing unit 4; and a fixer 5. Sheets of a predetermined size are fed from the sheet feeding cassette 2 to a sheet feeding path 3 on which the print drum 10 is located. The print head 8 forms an electrostatic latent image on the print drum 10. The developing unit 4 attaches toner ink to the latent image. The toner image formed on the print drum 10 is transferred to a sheet. The transferred image is then fixed by the fixer 5. The sheet is then discharged from the sheet discharging port 9.

Reference numeral 6 in the figure denotes a duplex path along which a sheet with an image printed on one side is turned upside down on a reversal path, guided to the print drum 10 again, and printed on its back side. Reference numeral 11 denotes an image reading device comprising a platen on which a document sheet is set, a scanning carriage that reciprocates along the platen, and a photoelectric conversion element such as a CCD which photoelectrically converts the document image scanned by the carriage. Reference numeral 12 denotes a document supply device comprising a tray on which a document is set in order to automatically feed a document to the platen, a conveying path along which the document from the stray is guided to the platen, and a sheet discharging tray. Document data read by the image reading device is transferred to a data storage in the print head 8. In other embodiments, the data storage is connected to an external apparatus such as a computer or a word processor to receive document data from the external apparatus.

Thus, the bookbinding device B in accordance with the present invention comprises "sheet collecting means C" for stacking sheets sequentially discharged from the discharge port 9 in the image forming apparatus A, in order of pages so as to arrange them into a bundle. Also included is a "bundle conveying unit D" for transferring the sheet bundle from the sheet collecting means along the bookbinding path, an "adhesive applying means E" located at an adhesive application position on the bookbinding path to apply an adhesive to the back of one end of the sheet bundle, a "cover sheet conveying means F" for feeding and setting a cover sheet at a binding position located downstream of the adhesive application position, a "binding unit G" located at the binding position to join the cover sheet and the sheet bindle together, and a "housing stack unit H" that houses the bookbound sheet bundle. Each of the arrangements will be described below.

Sheet Collecting Means

As shown in FIG. 1, a sheet carry-in path P1 is coupled to the sheet discharging port 9 in the image forming apparatus A. The sheet carry-in path P1 is located in a substantially horizontal direction and comprises a path traversing the center of the apparatus. The sheet carry-in path P1 is connected to a sheet feeding path P2 for an inserter J (described below) that feeds a cover sheet, and a saddle stitching sheet conveying path P3 along which sheets from the image forming apparatus A are conveyed. A path switching flapper 15 is provided at a fork in these paths. The saddle stitching sheet conveying path 3 is located so as to guide sheets from the sheet carry-in path P1, located in the center of the apparatus, to the upper part of the apparatus. A sheet discharging roller 21 (sheet conveying means) and a sheet sensor Se are provided at the sheet discharging port 20.

A collecting tray 22 is located downstream of the saddle stitching sheet conveying path P3 so as to form a step below the sheet discharging port 20. The collecting tray 22 has a sheet guide 25, an alignment roller 24, and a trailing end regulating member 23 that regulates the position of the trailing end of a sheet. The sheet guide 25 comprises a guide member that guides a sheet from the sheet discharging port 20 onto the collecting tray 22. The alignment roller 24 transfers a sheet placed on the tray after traveling along the sheet guide 25, in a sheet discharging direction (leftward in FIG. 2). With the trailing end of the sheet placed on the tray, the alignment roller 24 switches back the sheet so that the sheet travels in the opposite direction (rightward in FIG. 2). The trailing end of the sheet then abuts against the trailing end regulating member 23 for alignment. The alignment roller 24 is coupled to a driving motor M2 that can rotate both forward and backward. To switch back the sheet on the collecting tray 22 to align it with the trailing end regulating member 23, the sheet guide 25 swingabally moves from the sheet discharging port 20 to above the collecting tray 22 to guide the sheet. Driving means such as a working solenoid (not shown) is coupled to the sheet guide 25.

Although not shown, the collecting tray 22 includes aligning means for adjusting the width-wise posture of the sheet. In order to adjust the width-wise posture of the sheet on the basis of one end or the center, the aligning means comprises a lateral pair of aligning plates located on the tray so as to be movable in the width direction so that at least one of aligning plates can be reciprocated by a driving motor or the like. The above collecting tray 22 may be fixed to an apparatus frame, but in the figure, it is mounted on the apparatus frame so as to be movable up and down between a stack position and a carry-out position in the vertical direction of FIG. 1. A rack gear 28 provided on the collecting tray 22 meshes with a pinion 27 coupled to a tray elevating and lowering motor M4. The elevating and lowering motor M4 rotates forward and backward to move the collecting tray 22 up and down between the stacking position (shown by a solid line in FIG. 1) and the carry-out position (shown by a dashed line in FIG. 1). Accordingly, sheets collected on the collecting tray 22 are moved downward in the direction of arrow a and are then transferred in the direction of arrow b to grip conveying means 30 located behind the collecting tray 22.

The collecting tray 22 has sheet bundle thickness detecting means St for sensing the thickness of a sheet bundle stacked on the tray 22. The sensing means is, for example, a sly duck sensor and detects the position of a gripper gripping sheets on the collecting tray to detect the thickness of the sheet bundle on the basis of, for example, a resistance value. The sheet bundle thickness detecting means St detects the thickness of the sheet bundle collected on the collecting tray 22 to (1) set the gap between an adhesive applying roll described below and the sheet bundle in accordance with the thickness of the sheet bundle. The sheet bundle thickness detecting means St also (2) adjusts the position where a cover sheet is set and the amount by which the cover sheet is fed, in accordance with the thickness of the sheet bundle so that the sheet bundle coincides with the center of the cover sheet. The sheet bundle thickness detecting means St also (3) adjusts the position (standby position) where back folding press means is started in accordance with the thickness of the sheet bundle. That is, the sheet bundle thickness detecting means St is used for the subsequent process operations. Accordingly, the sheet bundle thickness detecting means St can adopt any of various methods for sensing the thickness. In addition, the sheet sensor Se at the sheet discharging port 20 counts the number of sheets, which is then multiplied by an average sheet thickness.

Bundle Conveying Unit

Figure 3:
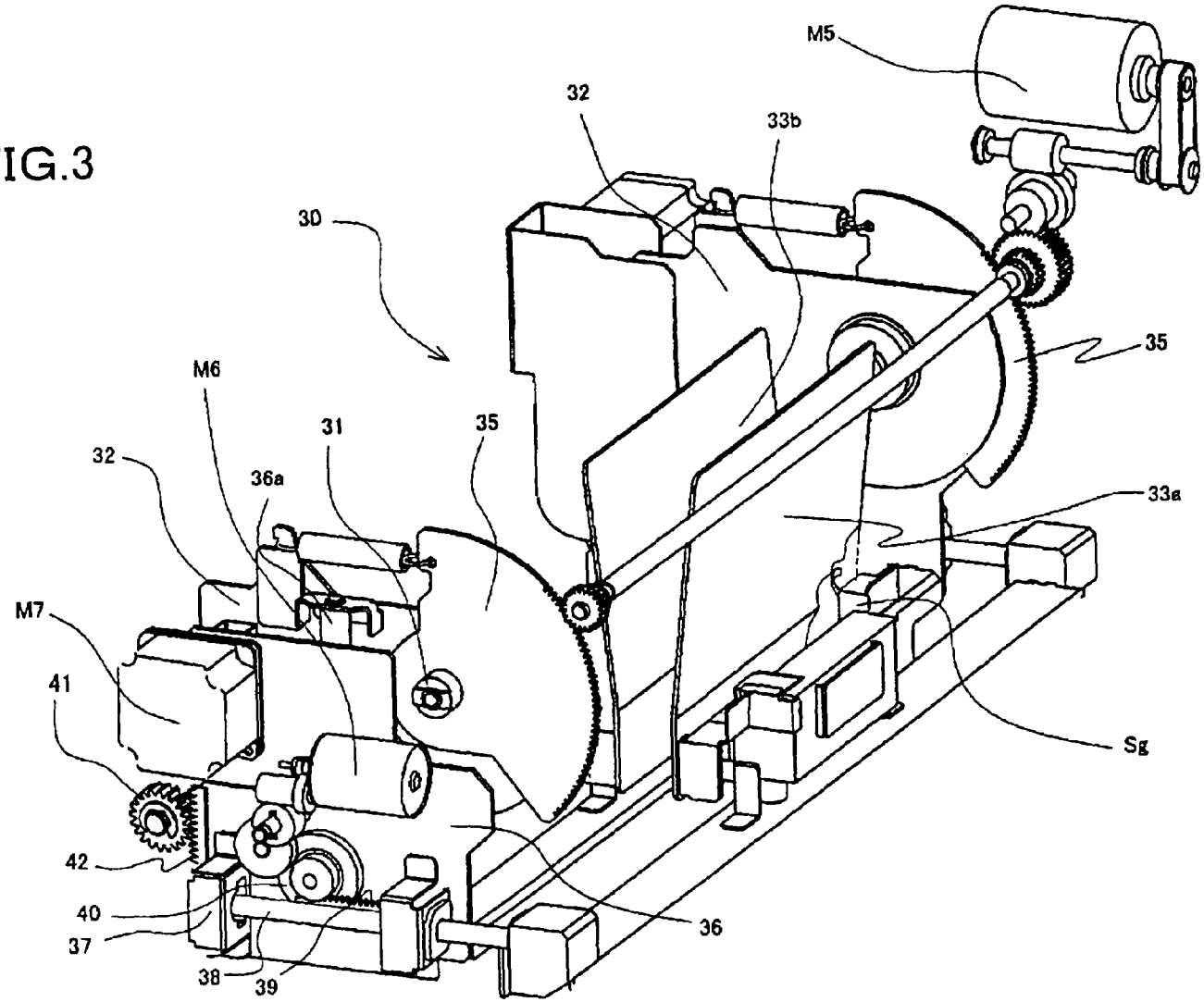
FIG. 3 is a diagram illustrating the configuration of grip conveying means in the apparatus in FIG. 1.

The bundle conveying unit D conveys a sheet bundle from the collecting tray 22 to the downstream adhesive applying position and comprises grip conveying means 30, as shown in FIG. 3. The grip conveying means 30 is placed on a bookbinding path P5 located so as to cross the bookbinding device B in the vertical direction of FIG. 1. The grip conveying means 30 receives a sheet bundle in a substantially horizontal posture from the collecting tray 22 and pivots the sheet bundle through 90° into a vertical posture. The grip conveying means 30 then transfers the sheet bundle to the downstream adhesive applying position. Thus, the grip conveying means 30 comprises a unit frame 32 that includes a pair of clampers 33*a* and 33*b* that grip a sheet bundle. The unit frame 32 is supported by the apparatus frame so as to be rotatable via a shaft 31. The unit frame 32 is pivoted clockwise and counterclockwise by using a pivoting motor M5 provided on the apparatus frame to rotationally drive a fan-shaped gear 35 provided around the shaft 31.

A movable frame 36 is fittingly supported on a guide rail 36*a* (partly shown in FIG. 3) provided on the unit frame 32 and thus is pivotally supported by the apparatus frame, the movable frame 36 movable in the vertical direction. A pinion 41 coupled to an elevating and lowering motor M7 provided on the unit frame 32 meshes with a rack gear 42 provided on the movable frame 36. The pair of clampers 33*a* and 33*b* is attached to the movable frame 36 as follows. The fixed clamper 33*b* is fixed to lateral side frames constituting the movable frame 36 at a width size that is appropriate to grip sheets. The movable clamper 33*a* has a rod 38 fittingly supported by a bearing 37 provided on the movable frame 36. A pinion of a grip motor M6 meshes with a rack gear 39 integrated with the rod 38.

Accordingly, the clampers 33*a* and 33*b* are operated by the grip motor M6 to perform a grip operation that grips a sheet bundle. The clampers 33*a* and 33*b* are then operated by the pivoting motor M5 to turn the gripped sheet bundle from the horizontal posture to the vertical posture. The clampers 33*a* and 33*b* are then operated by the elevating and lowering motor M7 to transfer the sheet bundle in the vertical posture along the sheet conveying path P5 to the downstream adhesive application position X. Reference character Sg denotes a grip end sensor located at the movable clamper 33*a* to detect whether or not the sheet bundle is reliably gripped at a predetermined pressure. The movable clamper 33*a* is moved by the grip motor M6 in a direction in which the sheet bundle is gripped, to approach the fixed clamper 33*b* to engage the sheet bundle.

This engagement turns on the grip sensor Sg, which then generates a signal to drive the grip motor M6 by a predetermined amount. Then, with the sheet bundle sandwiched between the clampers, the movable clamper 33*a* further approaches the fixed clamper 33*b* while storing energy in a regenerative spring (not shown). The movable clamper 33*a* then stops to enable the sheet bundle to be gripped at the predetermined pressure. In this condition, the elevating and lowering motor M7 is driven to move the grip conveying means 30 downward in FIG. 2, while gripping the sheet bundle. The grip conveying means 30 thus transfers the sheet bundle to the downstream adhesive application position X.

Adhesive Applying Means

Figure 4:
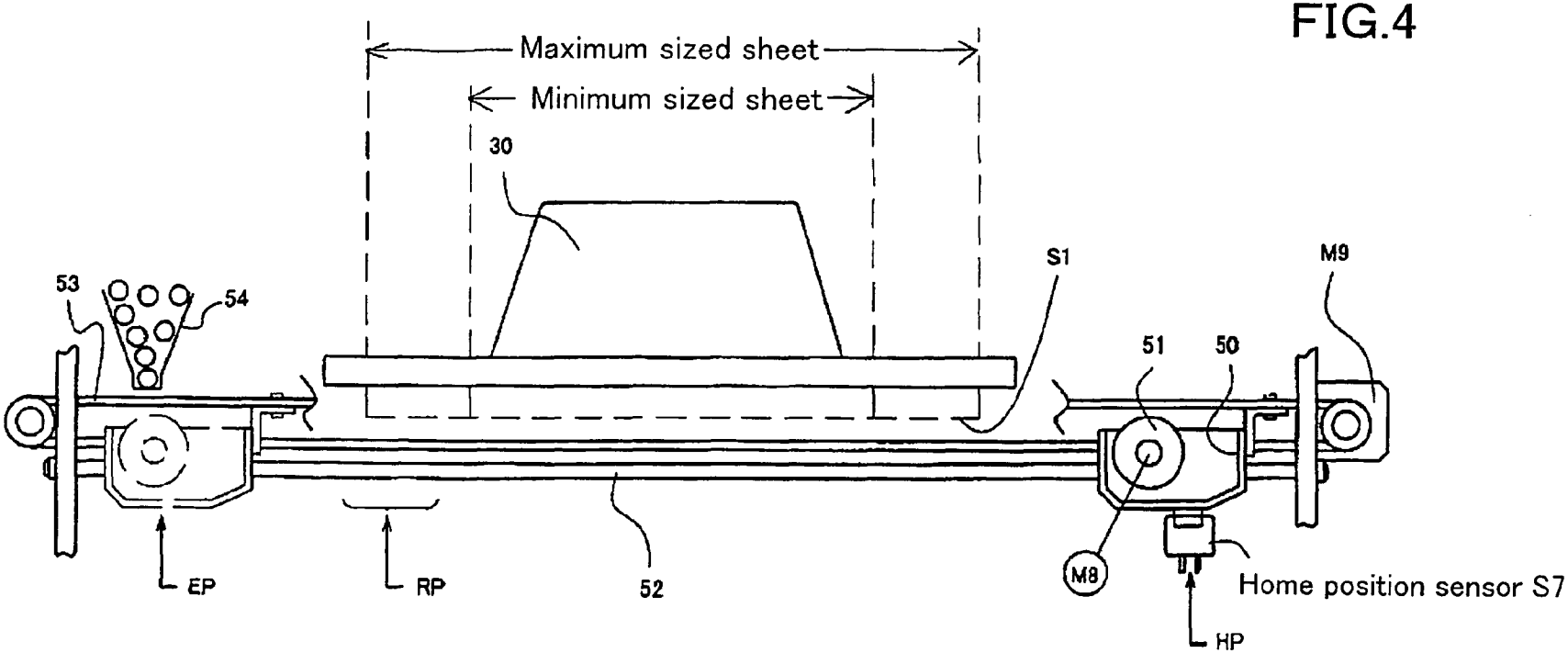
FIG. 4 is a schematic diagram illustrating adhesive applying means in the apparatus in FIG. 1.
Figure 5A:
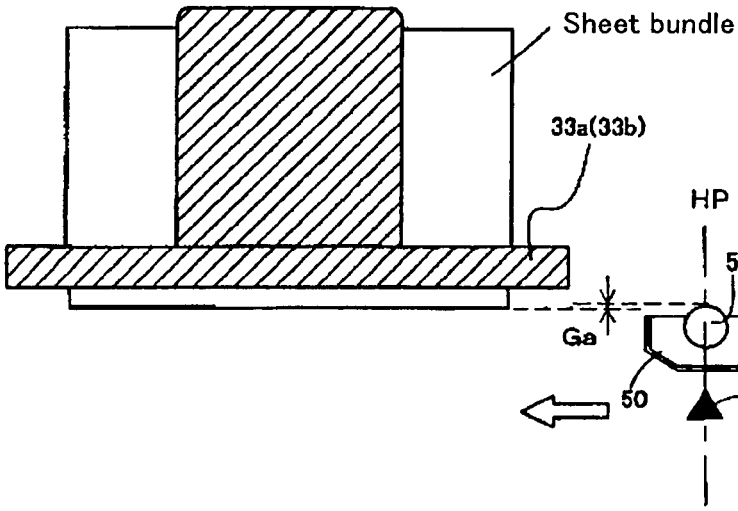
FIGS. 5(*a*)-5(*d*) are diagrams illustrating how the adhesive applying means in FIG. 4 applies an adhesive, wherein FIG. 5(*a*) shows that a container is being moved forward, FIG. 5(*b*) shows that the container is being moved backward, FIG. 5(*c*) is a sectional view of FIG. 5(*a*), and FIG. 5(*d*) is a sectional view of FIG. 5(*b*)
Figure 5C:
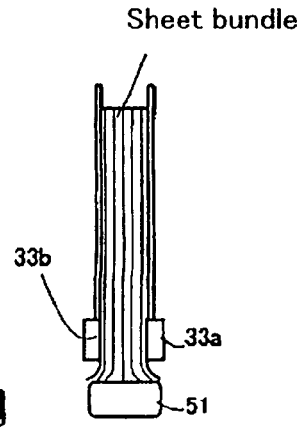
Figure 5B:
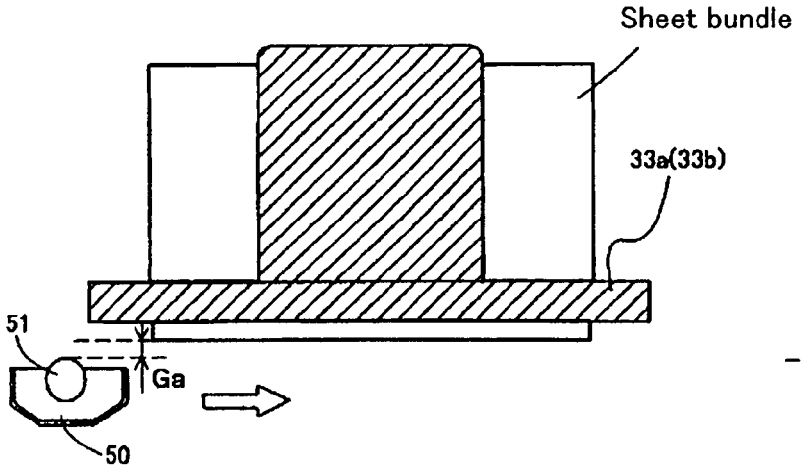
Figure 5D:
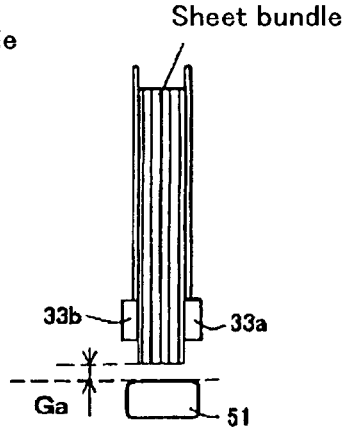

The adhesive applying means E comprises a paste container 50 accommodating an adhesive such as paste, an application roll 51 rotatably mounted in the container, a driving motor M8 that rotationally drives the application roll 51, and a driving motor M9 that reciprocates the paste container 50 along the sheet bundle. FIG. 4 shows a conceptual drawing of the adhesive applying means E. The paste container 50 is formed to have a smaller length (dimension) than the lower edge (back cover after bookbinding) of the sheet bundle. The paste container 50 is supported by the guide rail 52 (see FIG. 4) on the apparatus frame so as to move along the lower edge S1 of the sheet bundle together with the application roll 51, contained in the paste container 50. The paste container 50 is coupled to a timing belt 53 attached to the apparatus frame and coupled to the driving motor M9.

As described above, the paste container 50 itself moves along the sheet bundle. However, the paste container 50 may be shaped like a tray longer than the sheet bundle, with only the application roll 51 moving in the lateral direction of the figure. The illustrated application roll 51 is composed of a heat-resistant porous material and impregnated with paste so that a paste layer bulges around the periphery of the roll.

Thus, the paste container 50 is reciprocated by the driving motor M9 between a home position HP and a return position RP where a returning operation along the sheet bundle is started and a refilling position EP where the container with refilled with an adhesive. These positions are set in the positional relationship shown in FIG. 4, with the return position RP set on the basis of the sheet width size information. When the apparatus is powered on (initial state), the paste container 50 is set at the home position HP. A predetermined time (the expected amount of time required for the sheet bundle to reach the adhesive application position) after a preceding sheet grip signal from the grip sensor Sg of the grip conveying means 30, the paste container 50 moves from the home position HP to the return position RP. Simultaneously with the movement, the application roll 51 starts to be rotated by the driving motor M8. Reference numeral S7 in the figure denotes the home position of the paste container 50.

Rotation of the driving motor M9 starts to move the paste container 50 from the right to left of FIG. 4 along the guide rail 52. The feeding amount by the grip conveying means 30 is adjusted by the elevating and lowering motor M7 as follows. On this approach route, the application roll 51 comes into pressure contact with the sheet bundle to loosen the sheet ends (see FIGS. 5(*a*) and 5(*c*)). On a return route from the return position RP to the home position HP, a gap Ga is created between the sheet ends and the paste container 50 so that the adhesive can be applied to the sheet bundle (see FIGS. 5(*b*) and 5(*d*)). The application amount is adjusted on the basis of the amount by which the sheet bundle is fed so that on the basis of bundle thickness information from the sheet bundle thickness detecting means St, the gap Gs is increased to increase the application amount for a larger bundle thickness, whereas the gap Ga is reduced to decrease the application amount for a smaller bundle thickness. In some embodiments, a roll position adjusting means is provided that adjusts the vertical position of the application roll 51 instead of thus adjusting the amount by which the sheet bundle is fed by controlling the elevating and lowering motor M7 of the grip conveying means 30. The driving motor M9 responds to a standby instruction signal to move the paste container 50 from an operative position where the adhesive is applied to the sheet bundle to the standby position EP, where the paste container stands by away from the operative position. At the standby position, where an adhesive tank 54 is located, the paste container 50 is refilled with an adhesive.

Inserter

The sheet bundle with the adhesive applied thereto by the adhesive applying means E is then bound to a cover sheet. Feeding of the cover sheet will be described. Sheets with images formed thereon are sequentially carried out from the sheet discharging port 9 of the image forming apparatus A, where a sheet discharging stacker is normally provided. According to the present invention, the sheet carry-in path P1, serving as the bookbinding device B as described below, is coupled to the sheet discharging port 9. An inserter J is mounted on the sheet carry-in path P1. The inserter J comprises a stack tray 16 having one or more stages (two, in the figure) to stack sheets thereon, and pickup means 17 for separating a sheet from the other sheets on the stack stray 16 and the sheet feeding path P2, along which the sheet from the pickup means 17 is guided to the sheet carry-in path P1.

The sheets set on the stack tray 16 are supplied to the sheet carry-in path P1 after a series of sheets are carried out from the sheet discharging port 9 of the image forming apparatus A and before another series of sheets are carried out from the sheet discharging port 9 of the image forming apparatus A. That is, when a series of sheets with images formed thereon are carried out of the image forming apparatus A and the final sheet from the image forming apparatus reaches the stack tray 16, one of the sheets on the stack tray 16 starts to be fed. Accordingly, special sheets such as cardboards or coating paper are set on the stack tray 16 as cover sheets and carried into the sheet carry-in path P1 in response to a control signal from the bookbinding device B, described below. The stack tray 16 has the two stages so as to allow different types of cover sheets to be prepared in the stackers. Thus, a cover sheet is fed from a selected one of the stackers.

Cover Sheet Conveying Means

In the system in FIG. 1, the sheet feeding path P2 of the inserter J is coupled to the sheet carry-in path P1. A cover sheet from the sheet feeding path P2 is guided to the cover sheet feeding path P4 via the path switching flapper 15. The cover sheet feeding path P4 extends orthogonally to the bookbinding path P5. At the intersection (hereinafter referred to as a binding position K) between cover sheet feeding path P4 and the bookbinding path P5, a cover sheet is joined to a sheet bundle from the bookbinding path P5 for binding so that the cover sheet and sheet bundle form an inverted T shape. The cover sheet feeding path P4 comprises upper conveying guides 63*a* and 63*b* and lower conveying guide 63*d*, which are located opposite each other at a predetermined vertical distance between them. The upper conveying guide 63*a* is located on the right side of the intersection (binding position K) between cover sheet feeding path P4 and the bookbinding path P5, whereas the upper conveying guide 63*b* is located on the left side of the intersection. The right and left conveying guides 63*a* and 63*b* are individually opened and closed.

The cover sheet feeding path P4 includes registration means for registering a cover sheet both in a conveying direction and in a direction orthogonal to the conveying direction and cover sheet conveying means F for transferring the cover sheet registered by the registration means to the binding position K. The cover sheet conveying means F comprises a pair of conveying rollers arranged on the cover sheet feeding path P4 and comprising driving rollers 63*e* attached to the lower conveying guide 63*d* and driven rollers 63*c* attached to the upper conveying guides 63*a* and 63*b*. A driving roller M10 is coupled to the driving rollers 63*e*. The upper conveying guides 63*a*, 63*b*, and the driven rollers 63*c* are attached to the apparatus frame via cam levers, or the like, so as to be movable between a position where the driven rollers 63*c* come into pressure contact with the driving rollers 63*e* at a position where the upper conveying guides 63*a* and 63*b* and the driven rollers 63*c* are located above and away from the driving rollers 63*e*.

Accordingly, the upper conveying guides 63*a* and 63*b* and the driven rollers 63*c* can be moved by a driving motor for the cam levers (not shown) between an operative position where a cover sheet in the cover sheet feeding path comes into pressure contact with the driven rollers 63*c* (and is then transferred leftward in FIG. 2) and a retracting position where the upper conveying guides 63*a* and 63*b* and the driven rollers 63*c* are located above and away from the driving rollers 63*e*. Thus, the cover sheet is conveyed to the binding position K, the intersection between cover sheet feeding path P4 and the bookbinding path P5, where it is set at a predetermined position.

The upper conveying guides 63*a* and 63*b* at the binding position K comprise opening and closing guide plates so as to block the bookbinding path P5 and are movable between the position where the guides 63*a* and 63*b* guide the top of the cover sheet and the retracting position where they are retracted from the bookbinding path P5. The second upper conveying guide 63*b* is retracted upward to open the bookbinding path P5 after guiding the cover sheet as shown in FIG. 2.

Binding Unit

Cover sheet binding means 65 is provided at the binding position K to join a sheet bundle from the bookbinding path P5 to a cover sheet from the sheet feeding path P4 so that the sheet bundle and cover sheet form an inverted T shape and to press the back (back cover) of the cover sheet. First, on the bookbinding path P5, the adhesive applying means E applies an adhesive to the lower edge S1 of the sheet bundle gripped by the grip conveying means 30. The paste container 50 is retracted to the home position HP, located outside the path. The grip conveying means 30 transfers the sheet bundle along the bookbinding path P5 from the adhesive application position X to the binding position K. At the same time, the cover sheet is fed to the binding position, where it is set and remains stationary.

Figure 6:
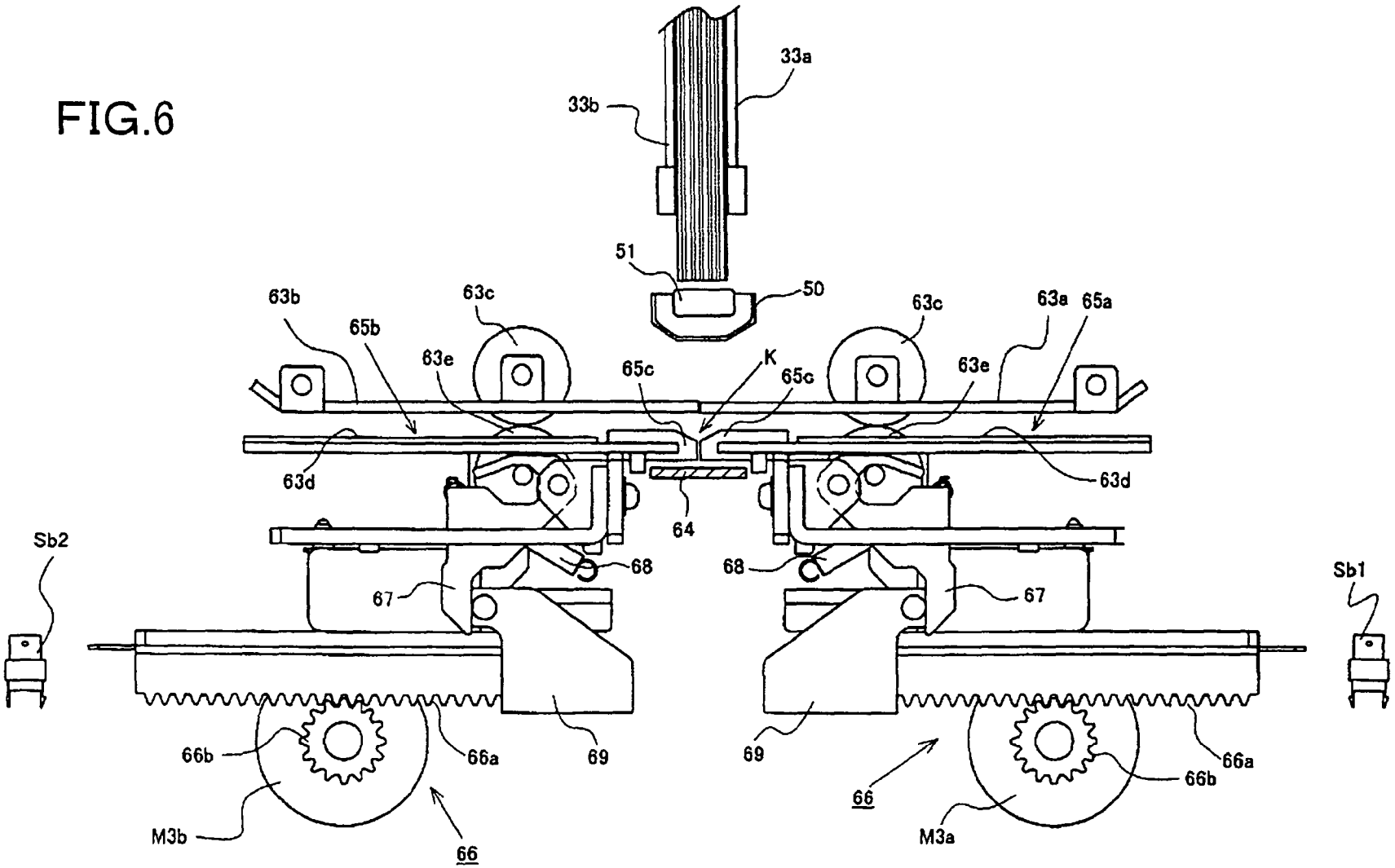
FIG. 6 is a diagram illustrating cover binding means in the apparatus in FIG. 1, showing that a bookbinding path is closed.
Figure 9D:
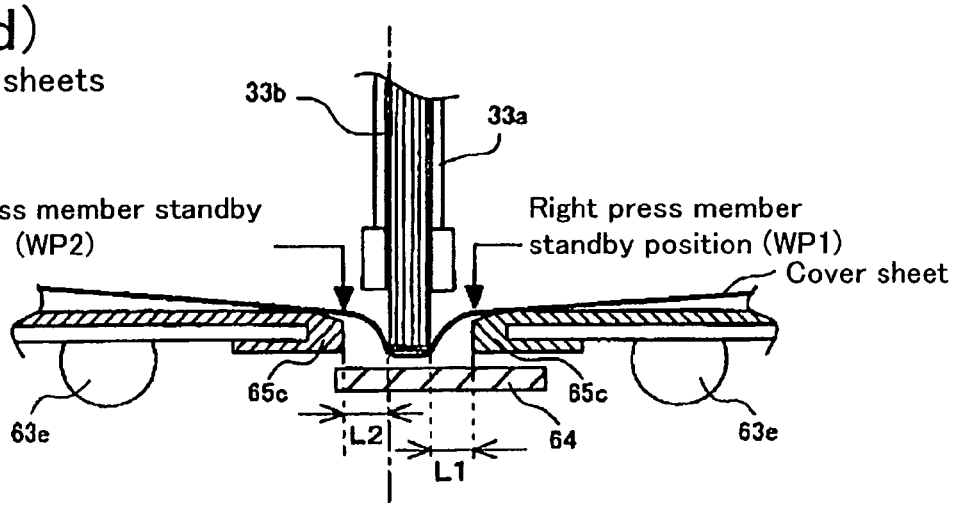
FIGS. 9(*d*) to 9(*f*) are diagrams illustrating the operation of the cover binding means in the device in FIG. 2, showing that the back folding press member is moving from the standby position to a back folding position.
Figure 9E:
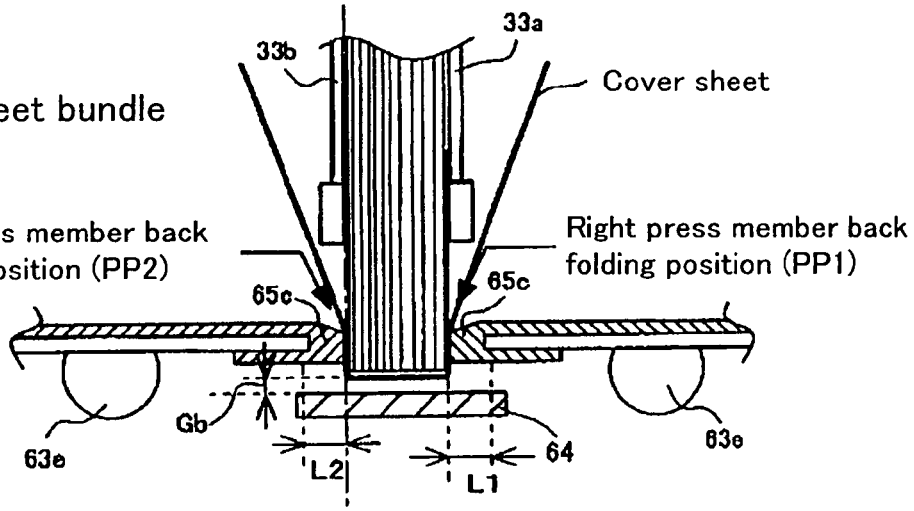
Figure 9F:
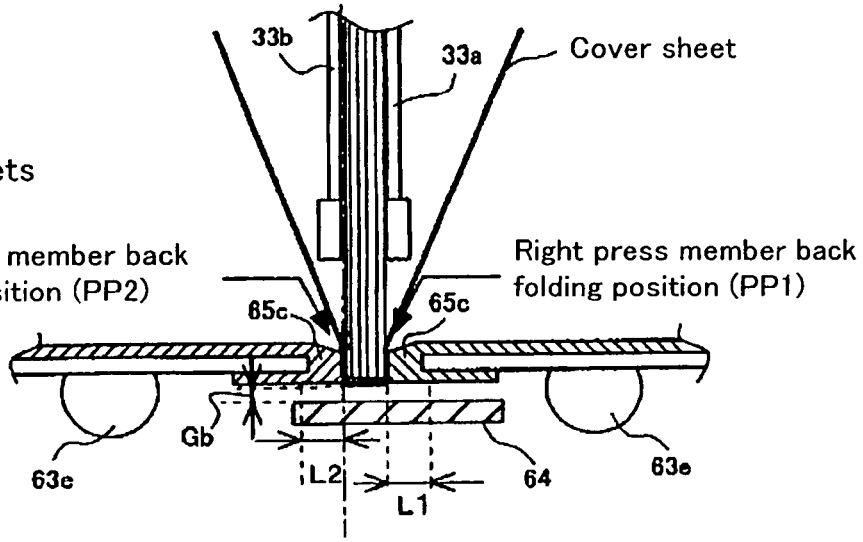

The cover sheet binding means 65 comprises a back rest plate member 64 and back folding press member 65*a* and 65*b*, as shown in FIG. 6. The back rest plate 64 is movable between an operative position where it enters the bookbinding path P5 and a retracting position where it is placed outside the path. The back rest plate 64 backs up the cover sheet set and remaining stationary on the cover sheet feeding path P4. The back rest plate 64 joins the cover sheet to the sheet bundle transferred from the bookbinding path P5 by the grip conveying means 30 so that the cover sheet and the sheet bundle form an inverted T shape. The cover sheet is backed up so as to form a small gap Gb between the lower end surface of the sheet bundle and the back rest plate 64, as shown in FIGS. 9(*d*) to 9(*f*), and described below. This is to prevent the adhesive from being cooled and solidified by the back rest plate 64 when the cover sheet is back-folded by the back folding press members 65*a* and 65*b*. The back rest plate 64 opens the bookbinding path P5 at the retracting position. The back rest plate 64 is retracted from the bookbinding path P5 to allow the grip conveying means 30 to carry the sheet bundle to a folding roll 70 positioned downstream of the binding means 65.

Accordingly, the back rest plate 64 is supported by the apparatus frame so as to be orthogonally movable across the bookbinding path P5. The back rest plate 64 is coupled to driving means (a solenoid, a motor, or the like; not shown). In particular, the illustrated back rest plate 64 is composed of a metal plate having a high heat conductivity to exert a high radiation effect. The back rest plate 64 thus cools the adhesive (in the figure, a hot-melt adhesive) applied to the sheet bundle.

The back folding press members 65*a* and 65*b* are located upstream of the back rest plate 64 configured as described above with a small gap Gb formed between both back folding press members 65*a* and 65*b* and the back rest plate 64. The back folding press members 65*a* and 65*b* fold back the sheet bundle and cover sheet joined together so that the sheet bundle and cover sheet form an inverted T shaped.

Figure 7:
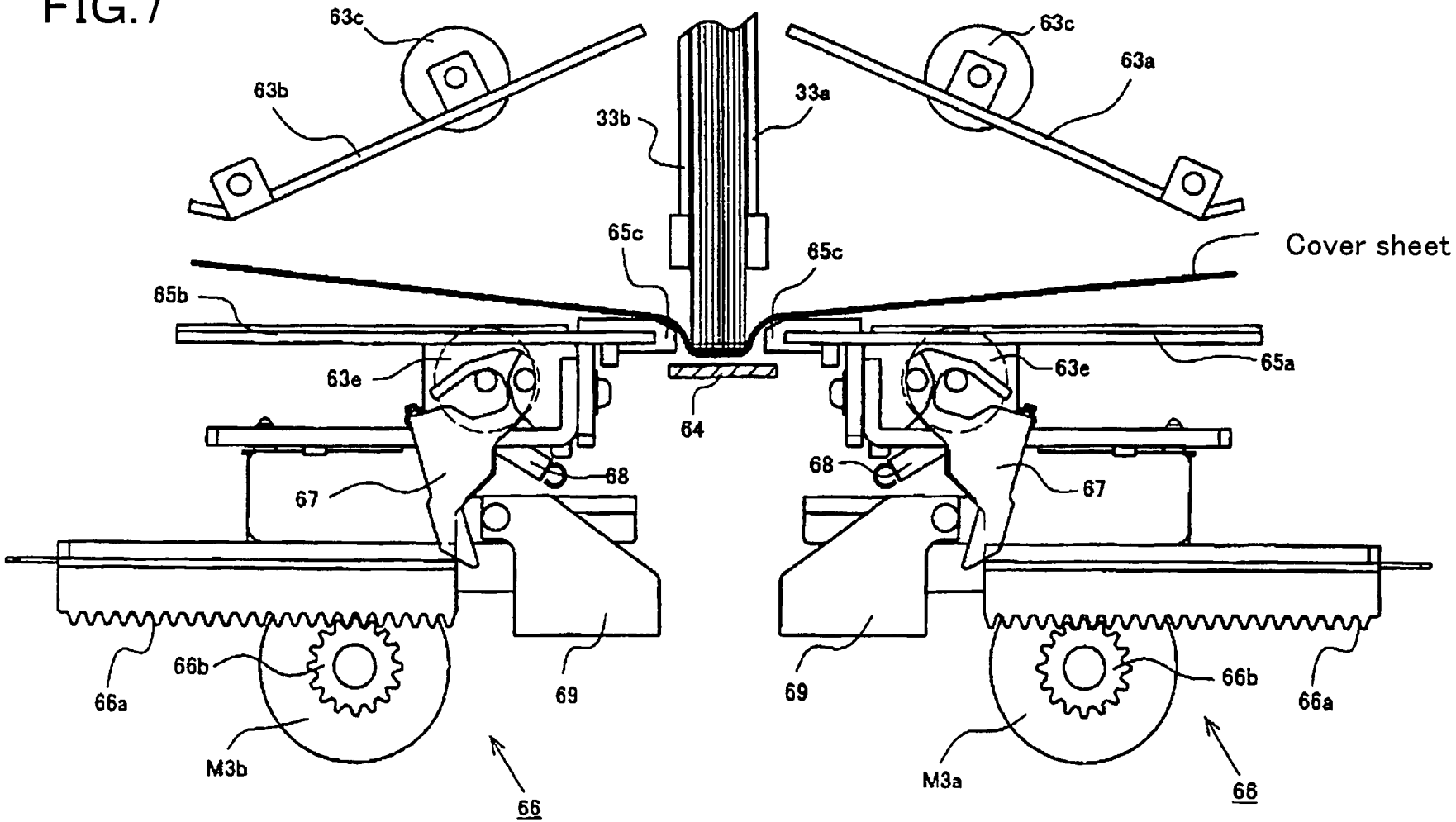
FIG. 7 is a diagram illustrating cover binding means in the apparatus in FIG. 1, showing that the bookbinding path is open.

The cover sheet binding means 65 comprises the lateral pair of back folding press members 65*a* and 65*b*, shift means 66 reciprocating the press members 65*a* and 65*b* between a back folding position (state shown in FIG. 6) and a standby position (state shown in FIG. 7) as shown in FIGS. 6 and 7, and control means (CPU 80 described below) for controlling the shift means 66. The right press member 65*a* and the left press member 65*a* are slidably supported by the apparatus frame (not shown). The right press member 65*a* and the left press member 65*a* each have a press piece at their tip so that the cover sheet is back-folded by the right and left press pieces 65*c*.

A rack gear is integrated with the lateral pair of back folding press members 65*a* and 65*b*. A pinion 66*b* coupled to shift motors M3*a* and M3*b* is meshed with the rack gear 66*a*. The shift motors M3*a* and M3*b* comprise stepping motors. Reference numerals Sb1 and Sb2 denote home position sensors that detect flags provided on the back folding press members 65*a* and 65*b*. Accordingly, the shift means 66 comprises the shift motors M3*a* and M3*b* and the transmission means (pinion 66*b* and rack gear 66*a*) for the shift motors M3*a* and M3*b*.

Each of the back folding press members 65*a* and 65*b* have a guide surface 63*d* (corresponding to the lower conveying guide described above) on which the cover sheet from the cover sheet feeding path P4 is guided. Thus, each of the back folding press members 65*a* and 65*b* comprises the press piece 65*c* at its tip and the guide surface 63*d* on its top surface, located opposite the cover sheet feeding path P4. The cover sheet is guided on the guide surface 63*d*. A pinch roller (corresponding to the driving roller described above) 63*e* is provided on the guide surface 63*d*.

While the bookbinding path P5 is closed by the back folding press members 65*a* and 65*b* at the back folding position, the cover sheet traversing the bookbinding path P5 is guided by the guide surface 63*d* and the pinch roller 63*e*. To be retracted to the standby position outside the path, the pinch roller 63*e* is placed below the guide, as shown in FIG. 7. Thus, an operating lever 67 is engaged with the pinch roller 63*e* biased by a bias spring (not shown) so as to normally project from the guide surface 63*d*. The operating lever 67 operates to place the roller below the guide surface 63*d* against the force of the bias spring. The operating lever 67 is pulled by a spring 68 exerting a stronger force than the bias spring, to pivot counterclockwise in the figure. An abutting stopper 69 is provided on the apparatus frame to rotate the operating lever 67 clockwise at the back folding position.

Thus, when the back folding press members 65*a* and 65*b* are at the back folding position (state shown in FIG. 6), the pinch roller 63*e* projects upward from the guide surface 63*d*. After the back folding press members 65*a* and 65*b* move from the back folding position toward the standby position, the pinch roller 63*e* is placed below the guide surface 63*d* by the spring 68. That is, at the back folding position, where the cover sheet is conveyed, the roller projects from the guide surface to smoothly guide the movement of the sheet. Before the back folding press members 65*a* and 65*b* move to the standby position in order to back-fold the cover sheet, the roller is placed below the guide surface 63*b* so as not to move the cover sheet set at the binding position.

Figure 8A:
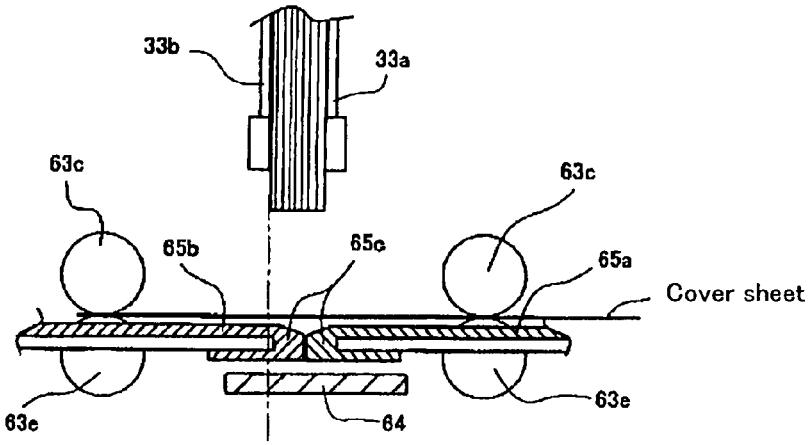
FIGS. 8(*a*)-8(*c*) are diagrams illustrating the operation of the cover binding means in the apparatus in FIG. 2, wherein FIGS. 8(*a*), 8(*b*), and 8(*c*) show that a back folding press member is moving from a home position to a standby position.
Figure 8B:
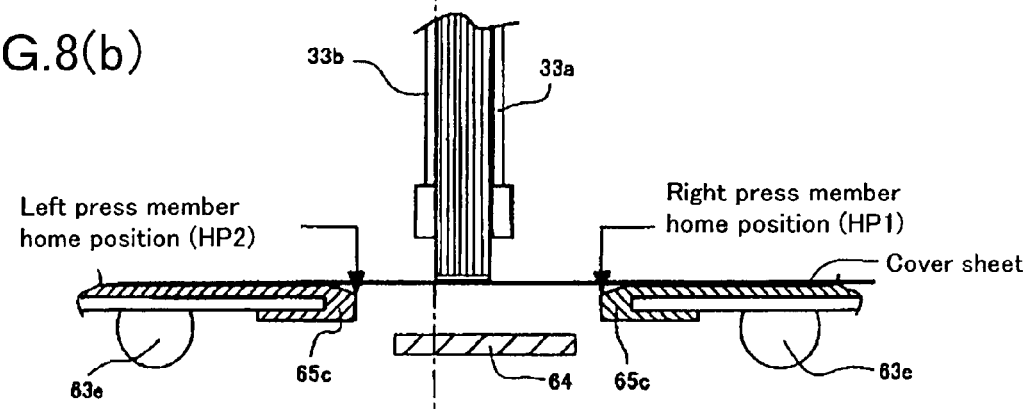
Figure 8C:
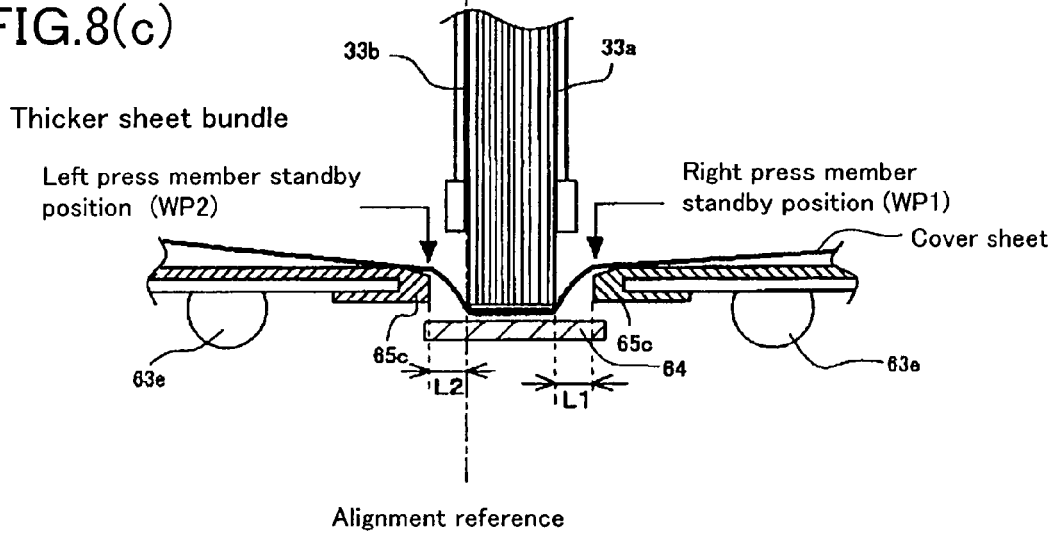

The back folding press members 65*a* and 65*b* configured as described above are controlled so that they are placed at the back folding position (FIG. 8(*a*)) before the cover sheet is fed from the cover sheet feeding path P4 to the binding position K and are placed at the home position (FIG. 8(*b*)), where they are retracted from the bookbinding path P5, before the cover sheet is joined to the sheet bundle from the bookbinding path P5. The back folding press members 65*a* and 65*b* then move from the home position to the standby position to wait until the operation of joining the cover sheet and sheet bundle together is completed (FIGS. 8(*c*) and 9(*d*)).

After the cover sheet and sheet bundle are jointed together, the press members move from the standby position to the back folding position (see FIGS. 9(*e*) and 9(*f*)). During the movement, the press members press the back of the sheet bundle. The binding process control means (control CPU described below) 80 comprises at least one of (1) means for varying the standby position of the back folding press members 65*a* and 65*b*, (2) means for varying an operation start timing for the movement of the back folding press members 65*a* and 65*b* from the standby position to the back folding position, and (3) means for varying the speed at which the back folding press members 65*a* and 65*b* move, depending on the thickness of the sheet bundle.

The control means (1) will be described. As shown in FIG. 8(*b*), the lateral pair of back folding press members 65*a* and 65*b* reciprocates between the home position HP and a standby position WP and a back folding position PP. The sheet bundle transferred along the bookbinding path P5 is fed to the binding position K with the movable clamper 33*a* assuming a posture varying depending on the bundle thickness, relative to the fixed clamper 33*b*, constituting the grip conveying means 30. Consequently, the distance L2 between a standby position WP2 and a back folding position PP2 for the left back folding press member 65*b* remains fixed regardless of the thickness of the sheet bundle.

A standby position WP1 for the right back folding press member 65*a* is varied depending on the thickness of the sheet bundle. The distance L1 between the standby position WP1 and a back folding position PP1 is set substantially equal to the distance L2. The control means (control CPU) 80 moves the lateral pair of back folding press members 65*a* and 65*b* from home positions HP1 and HP2 to the standby positions WP1 and WP2 in response to a timing signal indicating the arrival of the application roll 51 at the return position RP during the adhesive applying step, described above. To move the right back folding press member 65*a*, the control means (control CPU) 80 varies a driving step count for the shift motor M3*a* on the basis of thickness information from the sheet bundle thickness detecting means St to set the standby position WP1 so that the distance (L1) between the standby position WP1 and the back folding position PP1 remains fixed.

Thus, by varying the standby position WP1 of the back folding press member 65*a* depending on the thickness of the sheet bundle, a back folding operation can be performed in a given operation time even with a variation in bundle thickness. Unlike the present invention, were the standby positions of the back folding press members 65*a* and 65*b* fixed, the operation time would increase consistently with the thickness of the sheet bundle, varying the state of solidification of the adhesive depending on the thickness. However, the above control means prevents this.

The binding process control means (control CPU) 80, controlling the shift motors M3*a* and M3*b*, are further configured as follows. The control means (control CPU) 80 controllably moves the back folding press members 65*a* and 65*b* from the standby position WP to the back folding position PP. After performing the above operation to back-fold the cover sheet, the back folding press members 65*a* and 65*b* return to the standby position WP. At this time, the control means (control CPU) 80 maintains a pressed state for a predetermined holding time (hereinafter referred to as a press time) with the cover sheet back-folded by the press members 65*a* and 65*b*. After the set press time elapses, the back folding press members 65*a* and 65*b* are returned to the standby position WP.

At this time, the control means (control CPU) 80 adjusts the length of the press time in accordance with the basis weight and material of the front sheet and/or the thickness of the sheet bundle. As described below, the control means (control CPU) 80 comprises a control panel 81 having input means 83 via which information such as the basis weight and material of the front sheet is input. On the basis of a press time set on the basis of the input information, the control CPU performs the back folding operation. The press time is varied depending on the thickness of the sheet bundle. In this case, the press time is increased consistently with the basis weight or rigidity of the cover sheet or the thickness of the sheet bundle.

The binding process control means (control CPU) 80, in accordance with the present invention, is characterized by cooling the adhesive on the back cover of the sheet bundle following the back folding press of the cover sheet by the cover sheet binding means 65. The back rest plate 64 is composed of a material with high heat conductivity such as metal. Before the back folding press members 65*a* and 65*b* perform a back folding operation, a small gap Gb is formed between both back folding press members 65*a* and 65*b* and the lower end surface of the sheet bundle. After the back folding process, the back press plate 64 abuts against the back cover of the sheet bundle to cool and solidify the adhesive.

Figure 11:
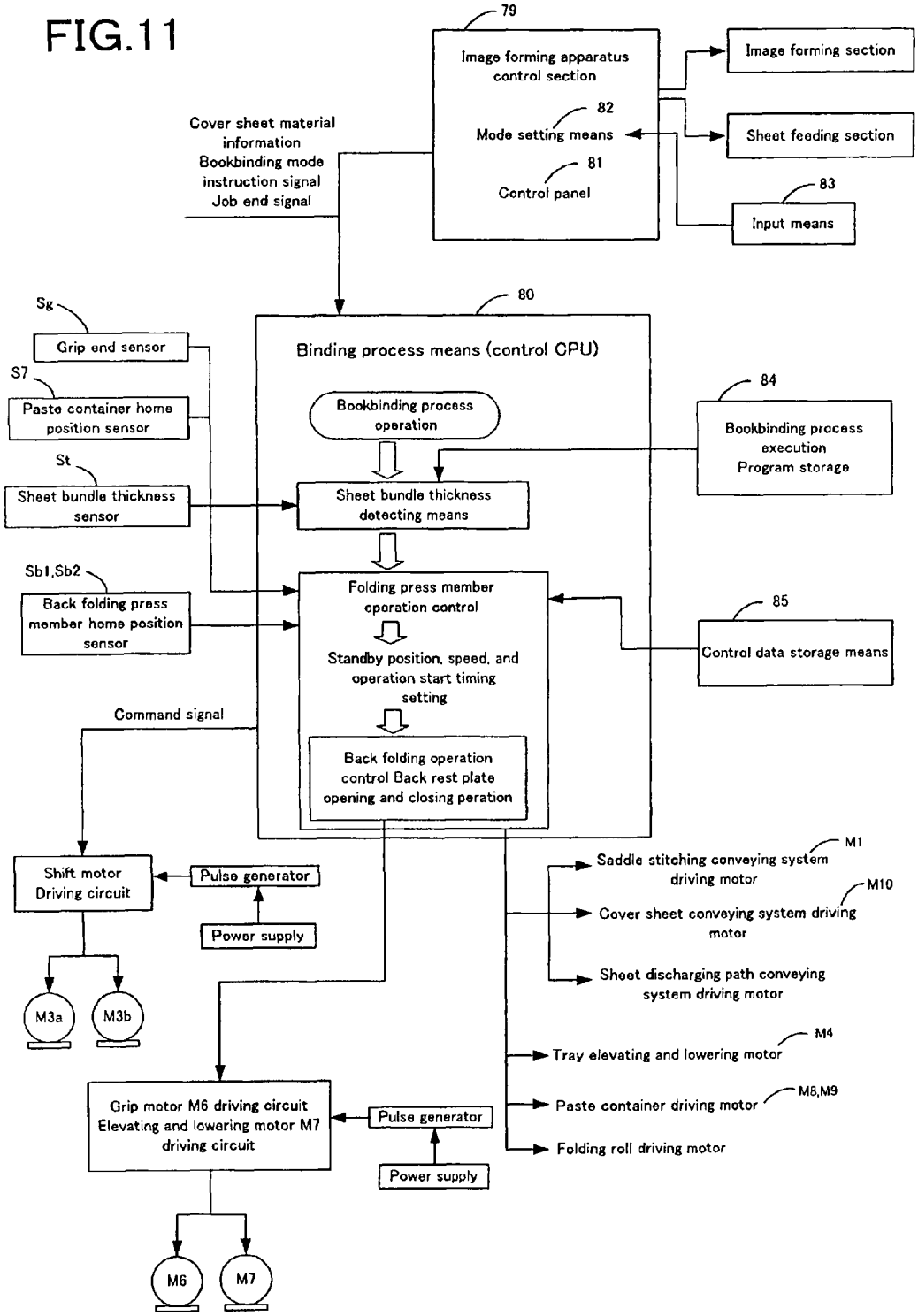
FIG. 11 is a block diagram showing the configuration of cover binding control means in the device in FIG. 2.

The configuration of the binding process control means (control CPU) 80 will be described with reference to the block diagram in FIG. 11. In a system in which the image forming apparatus A and the bookbinding device B are coupled together as shown in FIG. 1, for example, a control section of the image forming apparatus has the control panel 81 and mode setting means 82. A control CPU 79 in the image forming apparatus A allows the bookbinding device B to perform a bookbinding operation in accordance with, for example, a "print process mode" or a "bookbinding process mode" set via the control panel 81. In the print process mode, the bookbinding device B allows the path switching flapper 15 to convey print sheets carried into the sheet carry-in path P1 to a post process device P1 via the cover sheet feeding path P4 and sheet discharging path P6, shown in FIG. 2. The print sheets are housed in a stacker provided in the post process device 85. Accordingly, the print sheets pass only through the bookbinding device B.

Selection of the bookbinding process mode allows the bookbinding device B to guide the print sheets from the sheet carry-in path P1 to the saddle stitching sheet conveying path P3. Then, after a sheet collecting process, an adhesive applying process, and a cover sheet binding process, the bookbound sheets are housed in a housing stack unit H. Thus, selection of the bookbinding mode allows the control means (control CPU) 79 of the image forming apparatus A to transmit an instruction signal for the bookbinding mode and size information on the print sheets to the bookbinding device B.

At this time, thickness information such as the basis weight of the cover sheet and material information on the material of the cover sheet are input via the input means 83. The material information indicates, for example, whether the cover sheet is hard or soft. The information is transmitted to the binding process control means (hereinafter referred to as the control CPU) 80 of the bookbinding device B. Copy count information is transmitted to the control CPU 80. For a printing process for n pages, when printing of the last nth page is finished, a job end signal is transferred to the control CPU 80 of the bookbinding device B.

The control CPU 80 comprises a bookbinding control section and an inserter control section. The control CPU 80 connects to a conveying system driver circuit for the driving motor for the conveying roller on the sheet carry-in path P1, the driving motor M1 for the sheet discharging roller 21 on the saddle stitching sheet conveying path P3, and the driving motor M10 for the driving roller 63*e* on the cover sheet feeding path P4. The control CPU 80 similarly connects to a driving circuit for the tray elevating and lowering motor M4, which elevates and lowers the collecting tray 22, and for the grip motor M6 and elevating and lowering motor M7 that control the grip conveying means 30. The control CPU 80 also connects to the driving motor M8 for the application roller; the driving motor M9, which reciprocates the adhesive container; and shift motors M3*a* and M3*b* for the bask rest press members 65*a* and 65*b*. The grip motor M6, elevating and lowering motor M7, and shift motors M3*a* and M3*b* each comprise a stepping motor and receive command signals from the control CPU 80 indicating step count and speed. Connections are made such that the control CPU 80 issues command signals to a power supply pulse generator for each motor indicating pulse count, duty, driving start timing, and driving end timing for a pulse power supply.

On the other hand, connections are made such that the control CPU 80 receives a sense signal from the sheet bundle thickness detecting means St, sense signals from the grip end sensor Sg, the home position sensor S7 for the past container 50, and the home position sensors 65*a* and 65*b* for the back folding press members 65*a* and 65*b*, and detection signals from sheet sensing sensors located on the paths P1 to P6.

The control CPU 80 comprises storage means (ROM) 84 for control programs for performing an "operation for collecting saddle stitched sheets on the collecting tray 22," an "operation for allowing the grip conveying means 30 to transfer a sheet bundle from the collecting tray to the adhesive application position X and to the binding position K," an "operation for applying an adhesive to the sheet bundle at the adhesive application position X," an "operation for joining the sheet bundle and a cover sheet at the binding position K," a "back folding press operation for folding the joined cover sheet," and an "operation for carrying out the back-folded sheet bundle." The control CPU 80 also comprises storage means (RAM) 85 for speed information for the shift motors M3*a* and M3*b*, which drive the back folding press members 65*a* and 65*b*, respectively, and control data on start timings (timer table).

Figure 12:
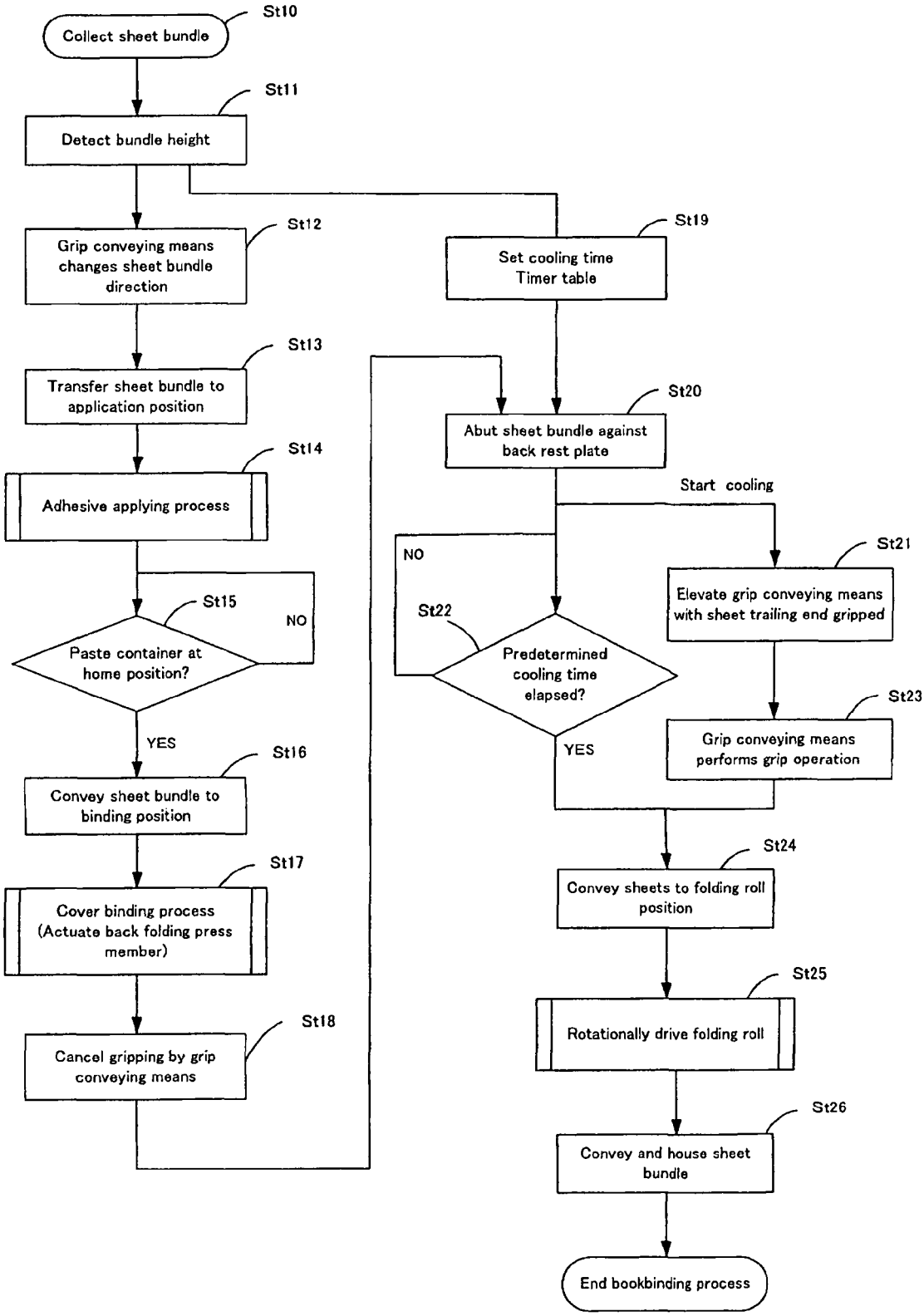
FIG. 12 is a flowchart showing the procedure of the operation of cover binding control means in the device in FIG. 2.

The control CPU 80 executes a bookbinding process as shown in the flowchart in FIG. 12. Predetermined print sheets are set on the collecting tray 22 (St10). The image forming apparatus A issues a job end signal to the control CPU 80, which then recognizes the thickness of the sheet bundle on the basis of a signal from the sheet bundle thickness detecting means St (St11). The sheet bundle thickness information is used in the subsequent process operations to (1) adjust the amount of adhesive applied by the application roll 51, (2) set the press time for the back folding press members 65*a* and 65*b*, and (3) set the cooling time for the back rest plate 64. Then, the control CPU 80 drives the tray elevating and lowering motor M4 to lower the collecting tray 22 to a carry-out position (shown by a dashed line in FIG. 1) to deliver the sheet bundle to the grip conveying means 30. The grip conveying means 30 allows the pivoting motor M5 to turn the sheet bundle from a horizontal posture to a vertical posture (St12).

The control CPU 80 then starts the elevating and lowering motor M7 for the grip conveying means 30 to transfer the sheets to the adhesive application position X (St13). At this time, the control CPU 80 varies the amount by which the sheet bundle is conveyed on the basis of the information on the thickness of the sheet bundle, resulting in the formation of the gap Ga between the application roll 51 and the sheet bundle. This control is performed by varying the step count of the elevating and lowering motor M7 depending on the power supply pulse count so that a larger gap Ga is set for a thicker sheet bundle, whereas a smaller gap Ga is set for a thinner sheet bundle.

Once the elevating and lowering motor M7 moves a distance corresponding to a predetermined step count, the control CPU 80 moves the paste container 50 forward from the home position HP to the return position RP and then backward from the return position RP to the home position HP. During the reciprocation of the paste container 50, the application roll 51 applies an adhesive to the lower edge S1 of the sheet bundle (St14). A signal is issued which indicates that the paste container 50 has returned to the home position HP. The control CPU 80 then transfers the sheet bundle to the binding position K. In this case, the step of the elevating and lowering motor M7 is controlled (St16). The control CPU 80 controls the elevating and lowering motor M7 so as to form a predetermined gap Gb between the lower edge S1 of the sheet bundle and the back rest plate 64.

On the other hand, before the operation of transferring the sheet bundle to the binding position K, the control CPU 80 has completed the operations of moving the back folding press members 65*a* and 65*b* to the back folding position in FIG. 8(*a*), to the home position in FIG. 8(*b*), and to the standby position in FIG. 9(*d*) and the operation of feeding and setting the cover sheet on the cover sheet feeding path P4.

The control CPU 80 then executes a cover sheet binding process (Stl7). FIG. 9(*e*) shows a thicker sheet bundle, and FIG. 9(*f*) shows a thinner bundle. The control CPU 80 moves the back folding press members 65*a* and 65*b* from the standby position to the back folding position. A small gap GB is already formed between the back rest plate 64 and the lower edge S1 of the sheet bundle. During the back folding operation, the back folding press members 65*a* and 65*b* fold the back cover into a flat, sharp straight line without cooling or solidifying the adhesive applied to the lower edge S1 of the sheet bundle.

The control CPU 80 then maintains the state shown in FIG. 9(*e*) or 9(*f*) for a predetermined press time in accordance with the thickness of the sheet bundle. For a thicker sheet bundle shown in FIG. 9(*e*), a longer press time is set. For a thinner sheet bundle shown in FIG. 9(*f*), a shorter press time is set. After the press time, the shift motors M3*a* and M3*b* are started to move the back folding press members 65*a* and 65*b* to the retracting position (home position).

Figure 10G:
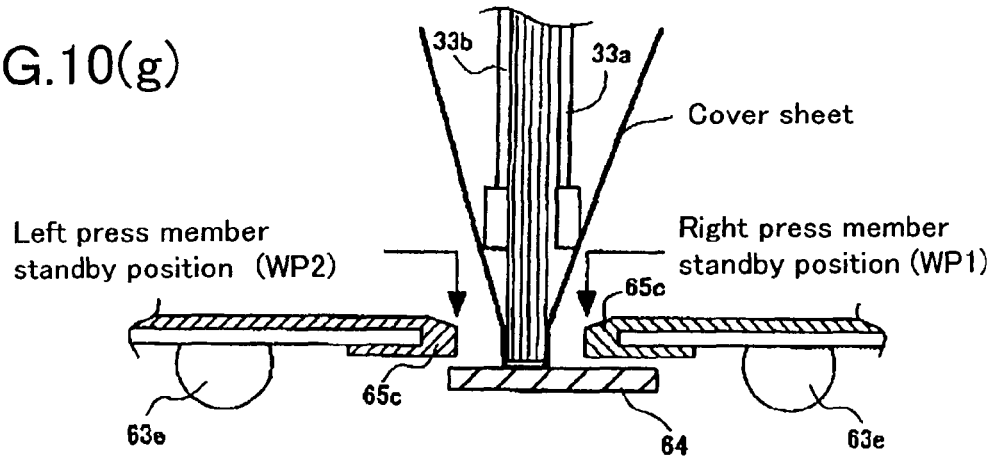
FIGS. 10(*g*) and 10(*i*) are diagrams illustrating the operation of the cover binding means in the device in FIG. 2, showing that the back folding press member has moved to the back folding position.
Figure 10H:
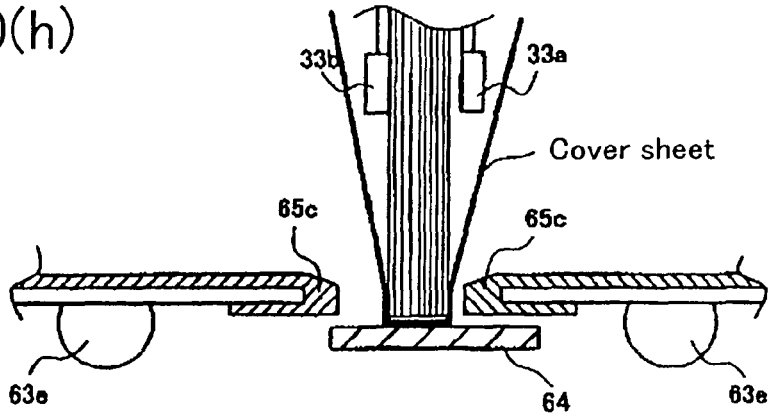

Simultaneously with the operation of retracting the back folding press members 65*a* and 65*b*, the control CPU 80 reversely rotates the grip motor M6 for the grip conveying means 30 to cancel gripping (Stl8). This grip canceling operation causes the sheet bundle to fall under its own weight as shown in FIG. 10(G), with its back cover abutting against the back rest plate 64 (St20).

The back cover abutting against the back rest plate 64 is formed into a flat surface on the plane of the plate. At the same time, the adhesive between the back cover and the sheet bundle is forcibly cooled by the plate. The control CPU 80 then sets the cooling time on the basis of a signal from the sheet bundle thickness detecting means St and the timer table in the control data storage means 85 (St19). In the timer table for the cooling time, predetermined times are set in association with sheet bundle thicknesses as shown in FIG. 13. A longer cooling time is set for a thicker sheet bundle on the basis of experimental values. Alternatively, the cooling time may be set on the basis of the environmental temperature of the apparatus and the thickness of the sheet bundle.

Figure 10:
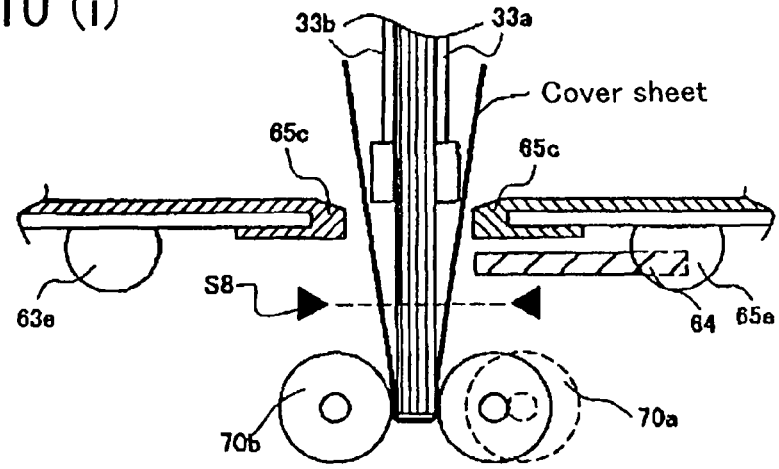

In accordance with the elapse of the time set in the timer table (St22), the control CPU 80 starts the elevating and lowering motor M7 for the grip conveying means 30 to elevate the clamper from the state in FIG. 10(*g*) to the state in FIG. 10(*h*) so that the clamper 33 can grip the lower of the sheet bundle (St21). The control CPU 80 subsequently starts the grip motor M6 to grip the sheet bundle (ST23).

Then, once the predetermined cooling time elapses, the control CPU 80 allows driving means (not shown) to retract the back rest plate 64 to outside the bookbinding path P5. The control CPU 80 then starts the elevating and lowering motor M7 to transfer the sheet bundle to the downstream folding roll 70 (St24). The illustrated folding roll 70 comprises a pair of opposite folding rolls 70. As shown in FIG. 10(*i*), one of the rolls, the roll 70*a*, is movable between a nip position and a separated position in accordance with the thickness of the sheet bundle. The roll 70*a* is controlled by actuating means such as a solenoid. The control CPU 80 moves the folding roll 70*a* to the nip position to nip and hold the sheet bundle, in response to a signal indicating that the illustrated sensor S8 has detected the lower end of the sheet bundle.

After the folding roller 70 nips the sheet bundle, the control CPU 80 releases the grip motor M6 for the grip conveying means 30 and then allows the driving motor (not shown) to rotationally drive the folding roll 70 (St25). The sheet bundle is housed in a stacker provided below the folding roll 70 (St26).

The disclosure of Japanese Patent Application No. 2006-128708 filed on May 2, 2006 is incorporated as a reference.

While the invention has been explained with reference to the specific embodiments of the invention, the explanation is illustrative and the invention is limited only by the appended claims.

What is claimed is:

1. A bookbinding device comprising:

collecting means for collecting sheets with images printed thereon, into a sheet bundle;

a bookbinding path having sheet bundle conveying means and along which the sheet bundle from the collecting means is sequentially subjected to a bookbinding process;

adhesive applying means located at an adhesive application position on the bookbinding path for applying an adhesive to an end surface of the sheet bundle;

a cover sheet feeding path on which, at a cover binding position located downstream of the adhesive application position, a cover sheet is fed from a direction crossing the bookbinding path;

cover binding means located at the cover binding position for binding the sheet bundle to the cover sheet;

cover binding control means for controlling the cover binding means; and conveying roller means for carrying the sheet bundle out from the cover binding position, wherein the cover binding means comprises:

a back folding press member located at the cover binding position for back-folding the cover sheet; and a back rest plate member located downstream of the back folding press member for backing up the cover sheet;

wherein the cover binding control means controls: the back folding press member so that the back folding press member executes a back folding process forming a predetermined gap between the back rest plate member and a back of the sheet bundle; the sheet bundle to abut against the back rest plate member to thereby cool the adhesive after the back folding process; and retracting the back rest plate member from the bookbinding path to outside the path after an adhesive cooling time elapses, wherein the sheet bundle conveying means comprises grip conveying means for gripping and conveying the sheet bundle, and the cover binding control means performs control such that the back folding press member back-folds the cover sheet with a back folding end of the sheet bundle gripped by the grip conveying means, and after the back folding process, the sheet bundle is fed to the conveying roller means with a centrally back end of the sheet bundle gripped by the grip conveying means, and after the back folding process, the cover binding control means releases the grip conveying means and abuts the back of the sheet bundle against the back rest plate member.

2. An image forming apparatus comprising:

image forming means for sequentially forming images on sheets;

collecting means for collecting the sheets with images printed thereon, into a bundle;

a bookbinding path along which the sheet bundle from the collecting means is sequentially subjected to a bookbinding process;

sheet bundle conveying means located on the bookbinding path for conveying the sheet bundle from the collecting means;

adhesive applying means located at an adhesive application position on the bookbinding path for applying an adhesive to an end surface of the sheet bundle;

a cover sheet feeding path on which, at a cover binding position located downstream of the adhesive application position, a cover sheet is fed from a direction crossing the bookbinding path;

cover binding means located at the cover binding position for binding the sheet bundle to the cover sheet;

cover binding control means for controlling the cover binding means; and conveying roller means for carrying out the bundle from the cover binding position;

wherein the cover binding means comprises:

a back folding press member located at the cover binding position for back-folding the cover sheet; and a back rest plate member located downstream of the back folding press member for backing up the cover sheet, the cover binding control means controls the back folding press member so that the back folding press member executes a back folding process with a small gap formed between the back rest plate member and a back of the sheet bundle; controls such that after the back folding process, the back of the sheet bundle is abutted against the back rest plate member to cool the adhesive; controls such that after a cooling time for the adhesive elapses, the back rest plate member is retracted from the bookbinding path to outside the path; and varies the cooling time depending on a thickness of the sheet bundle.

3. A bookbinding device comprising:

collecting means for collecting sheets with images printed thereon, into a sheet bundle;

a bookbinding path having sheet bundle conveying means and along which the sheet bundle from the collecting means is sequentially subjected to a bookbinding process;

adhesive applying means located at an adhesive application position on the bookbinding path for applying an adhesive to an end surface of the sheet bundle;

a cover sheet feeding path on which, at a cover binding position located downstream of the adhesive application position, a cover sheet is fed from a direction crossing the bookbinding path;

cover binding means located at the cover binding position for binding the sheet bundle to the cover sheet;

cover binding control means for controlling the cover binding means; and conveying roller means for carrying the sheet bundle out from the cover binding position, wherein the cover binding means comprises:

a back folding press member located at the cover binding position for back-folding the cover sheet; and a back rest plate member located downstream of the back folding press member for backing up the cover sheet;

wherein the cover binding control means controls: the back folding press member so that the back folding press member executes a back folding process to the cover sheet while forming a predetermined gap between the back rest plate member and a back of the sheet bundle with the adhesive thereon; the sheet bundle and the cover sheet with the adhesive therebetween to abut against the back rest plate member for a predetermined time period changed according to a thickness of the sheet bundle to thereby cool the adhesive after the back folding process; and retracting the back rest plate member from the bookbinding path to outside the path after an adhesive cooling time elapses.

4. The bookbinding device according to claim 3, wherein the cover binding control means comprises:

at least one of sheet bundle thickness detecting means for detecting the thickness of the sheet bundle from the collecting means to the cover binding position and counting means for counting the number of sheets in the collecting means; and wherein the cover binding control means varies the cooling time depending on the thickness of the sheet bundle on a basis of information from the at least one sheet bundle thickness detecting means and counting means.

5. The bookbinding device according to claim 3, wherein the cover binding control means controls an amount that the sheet bundle is transferred by the sheet bundle conveying means to form, at the cover binding position, the predetermined gap between the back of the sheet bundle and the back rest plate member.

6. The bookbinding device according to claim 3, wherein the back rest plate member comprises a heat conductive material to cool the back of the sheet bundle back-folded by the back folding press member.

7. The bookbinding device according to claim 3, wherein the back folding press member comprises a lateral pair of back folding press members arranged on the bookbinding path so that at least one of the back folding press members is movable between a standby position outside the path and a back folding position in the path, and the back rest plate member is located so as to form the predetermined gap between the back rest plate member and the back of the sheet bundle so that a predetermined back cover adhesive layer is formed when the back folding press member back-folds the cover sheet on the back of the sheet bundle.

8. A bookbinding device comprising:

collecting means for collecting sheets with images printed thereon, into a sheet bundle;

a bookbinding path having sheet bundle conveying means and along which the sheet bundle from the collecting means is sequentially subjected to a bookbinding process;

adhesive applying means located at an adhesive application position on the bookbinding path for applying an adhesive to an end surface of the sheet bundle;

a cover sheet feeding path on which, at a cover binding position located downstream of the adhesive application position, a cover sheet is fed from a direction crossing the bookbinding path;

cover binding means located at the cover binding position for binding the sheet bundle with an adhesive at an end thereof, to the cover sheet;

cover binding control means for controlling the cover binding means; and conveying roller means for carrying the sheet bundle out from the cover binding position, wherein the cover binding means comprises:

a back folding press member located at the cover binding position for back-folding the cover sheet; and a back rest plate member located downstream of the back folding press member for backing up the cover sheet;

wherein the cover binding control means controls such that the adhesive at the end of the sheet bundle folded by the folding press member is cooled by the back rest plate member, and after a predetermined time for cooling the adhesive set to be different according to a thickness of the sheet bundle, the back rest plate member is retracted from the bookbinding path to outside the path.

9. The bookbinding device according to claim 8, wherein the back folding press member comprises a lateral pair of back folding press members arranged on the bookbinding path so that at least one of the back folding press members is movable between a standby position outside the path and a back folding position in the path, and the cover binding control means controls such that when the cover sheet is folded at a back of the sheet bundle by the back folding press member, a predetermined gap is formed at the cover binding position, by controlling a moving amount of the sheet bundle by the sheet bundle conveying means, between the back rest plate member and the back of the sheet bundle to thereby form a predetermined back cover adhesive layer therebetween.

10. The bookbinding device according to claim 9, wherein the back folding press member folds the cover sheet to the back of the sheet bundle, and the back rest plate member contacts the back of the sheet bundle to cool the adhesive after the cover sheet is folded.

11. An image forming apparatus comprising:

image forming means for sequentially forming images on sheets; and the bookbinding device according to claim 8, the bookbinding device collecting the sheets with the images thereon into the sheet bundle and binging the cover sheet.

12. The image forming apparatus according to claim 11, wherein the back folding press member comprises a lateral pair of back folding press members arranged on the bookbinding path so that at least one of the back folding press members is movable between a standby position outside the path and a back folding position in the path, and the cover binding control means controls such that when the cover sheet is folded at a back of the sheet bundle by the back folding press member, a predetermined gap is formed at the cover binding position, by controlling a moving amount of the sheet bundle by the sheet bundle conveying means, between the back rest plate member and the back of the sheet bundle to thereby form a predetermined back cover adhesive layer therebetween.

* * * * *